US006638124B2

(12) United States Patent
Zoubul et al.

(10) Patent No.: US 6,638,124 B2
(45) Date of Patent: Oct. 28, 2003

(54) ARRANGEMENT IN A MARINE EXHAUST SYSTEM

(75) Inventors: George Zoubul, Chesapeake, VA (US); William M. Cahoon, Chesapeake, VA (US)

(73) Assignee: AB Volvo Penta, Göteborg (SE)

( * ) Notice: Subject to any disclaimer, the term of this patent is extended or adjusted under 35 U.S.C. 154(b) by 0 days.

(21) Appl. No.: 10/064,497

(22) Filed: Jul. 22, 2002

(65) Prior Publication Data

US 2003/0060100 A1 Mar. 27, 2003

Related U.S. Application Data

(60) Provisional application No. 60/306,742, filed on Jul. 21, 2001.

(51) Int. Cl.[7] ..... B63H 21/32
(52) U.S. Cl. ..... 440/89; 440/89 R
(58) Field of Search ..... 440/89 R, 89 A, 440/89 B, 89 E, 89 F

(56) References Cited

U.S. PATENT DOCUMENTS 4,926,634 A * 5/1990 Putz et al. ..... 60/274
5,018,349 A * 5/1991 Pemberton ..... 60/313
5,259,797 A * 11/1993 Miles, Jr. et al. ..... 440/89

* cited by examiner

*Primary Examiner*—Ed Swinehart
(74) *Attorney, Agent, or Firm*—Howrey, Simon, Arnold & White LLP

(57) ABSTRACT

Method and arrangement for a marine combustion engine exhaust system. The arrangement includes at least two substantially upstanding exhaust pipe arms that are coupled together in common closed fluid communication with a stem exhaust pipe. A pressure equalizer is fluidly connected between the upstanding exhaust pipe arms. The pressure equalizer is configured to provide sufficient fluid passage from each exhaust pipe arm to another to prevent flow back of sea water to a marine combustion engine associated therewith.

6 Claims, 8 Drawing Sheets

ARRANGEMENT IN A MARINE EXHAUST SYSTEM

CROSS REFERENCE TO RELATED APPLICATIONS

The present application claims the benefit of U.S. Provisional Application No. 60/306,742 filed Jul. 21, 2001.

BACKGROUND OF INVENTION

1. Technical Field

The present invention relates to exhaust systems for combustion engines; and more specifically, it relates to configurations in exhaust systems for marine combustion engines designed to prevent the detrimental back flow of sea water through the exhaust system into the cylinders of the combustion engine.

2. Background Information

The present invention takes the form of a design characteristic or adaptation to the exhaust system of a combustion engine utilized in a marine vehicle such as a sport-boat. Referring to typical arrangements in boats of this nature, one configuration includes a stern-drive that is connected to the powering combustion engine across a transom wall of the boat. In such a configuration, the engine itself is located in an engine compartment at the rear area of the boat. Exhaust produced by the engine is ported through the transom, and typically, at least partially passes through the stern-drive assembly to ultimately be released to the environment. As the exhaust passes from the engine to the stern-drive unit, the elevated exhaust pressure is permitted to drop substantially to atmospheric pressure. Because the ultimate porting of the exhaust is below the boat's static waterline, at least when the boat is at standstill and moving at slow speeds, the pressure of the exhaust must remain sufficiently above atmospheric to prevent the sea water's inundation. When the engine is running, there is ample exhaust pressure to overcome the hydrostatic pressure of the water being exerted thereupon and prevent sea water from moving into the exhaust arrangement and toward the combustion engine.

At least one typical marine engine configuration takes the form of a V8 combustion engine having eight cylinders oriented at a 90 degree V-angle. Four of the eight cylinders are arranged in banks on each of two sides of the engine; the exhaust from these two cylinder banks are respectively ported to two different exhaust manifolds. Connected to each manifold is a riser which generally provides a right-angle turn or elbow terminating in a substantially horizontally oriented exhaust pipe. These two exhaust pipes are directed rearwardly away from the engine and toward the rear transom of the boat. At a position in the mid-length of each exhaust pipe, spent cooling sea water is often introduced thereinto after having been circulated through the engine for cooling purposes.

At the rearward region of the engine, a Y-configured piping arrangement is utilized to combine the two exiting exhaust streams into one. This Y-configured piping arrangement is substantially vertically oriented with two upper V-arranged arms oriented above, and in fluid communication with, an upright leg portion which forms the bottom of the Y. Based on this configuration, exhaust passes downwardly through each arm of the V-arrangement, further down through the upright leg, and then out at a bottom portion thereof to the stern-drive unit for ultimate release. When the boat is at rest and the engine is not running, the static waterline is typically, with respect to vertical, positioned approximately midway up each of the V-arranged arms.

Based on historical experience, and now experimentation, it has been appreciated that during certain shutdown procedures, and rather unpredictably, sea water is permitted to rise up through the Y-configured piping arrangement to a level that the liquid detrimentally flows back into the cylinders of the combustion engine.

In another situation, it has also been appreciated that sea water can be permitted to flow back into the engine's cylinders. This situation occurs when the engine is abruptly shut down when the boat is traveling at high speeds. When traveling at cruise speeds, a sport boat is typically planing across the top of the water. If the engine is shutdown under these conditions, the boat settles quickly back into a displacement orientation in the water. Still further, as the boat is settling and quickly slowing, a surge of water is experienced at the back or transom of the boat. The resulting hydraulic pressure upon the stern drive can also cause sea water to travel up the Y-configured piping arrangement resulting in flow back into the engine's cylinder(s).

Based on one embodiment of an exemplary V8 engine, the operation of the engine is characterized as "odd firing on each bank." That is to say, these are not alternating cylinders firing at 180 degrees to one another, as is more typical. Instead you have a cylinder sequence that can be 90 degrees, 180 degrees, and 270 degrees apart. It is theorized that this operational sequence, under certain stroke conditions, can cause unbalanced exhaust pulses from each of the two different cylinder banks or manifolds. As a result, the exhaust pressures being experienced in the two arms of the V-arrangement are not always equal. Normally this does not present a problem, unless cessation of the engine's operation (shutdown) is caused to occur when the engine is at one of these imbalanced sequences. When this pressure imbalance does occur and the boat begins to settle into the water after shutdown, the hydrostatic pressure of the external sea water progressively rises up the lower upright leg of the Y-arrangement. As the rising water encounters the two V-oriented arms and the out-of-balance exhaust pressures contained therebetween, the rising water is directed up the lower pressured arm, at a much greater rate than if the arms were in balance with respect to pressure. Upon reaching the upper portion of the respective V-arm, and especially the low-pressure arm, the water flows over the riser and is permitted to drain back into the engine.

It is under these irregularly occurring imbalanced exhaust pressure shutdown conditions that detrimental flow-back into the engine may occur. When such flow-back has occurred, several highly undesirable affects can be encountered upon restarting the engine. Primarily, these affects stem from what is termed hydro-lock. Hydro-lock describes the situation in which a sufficient volume of water has been introduced into the cylinder so that upon a compression stroke, where a volume of fuel and air mixture is designed to be compressed to a clearance volume, the substituted water volume which is relatively incompressible in comparison to such a fuel/air mixture causes the engine to seize-up. This is also referred to as "going hydraulic" with regard to the engine's operation. When this occurs, any number of detrimental conditions may be caused including bent connecting rods, a broken starter and cracked engine blocks.

It is for these reasons that the present invention has been designed in order to help prevent engine damage as a result of flow back of sea water through the exhaust-pipe arrangement of a marine vehicle.

SUMMARY OF INVENTION

The present invention provides an arrangement which successfully prevents the described flow back of sea water through the exhaust-pipe arrangement to the combustion engine associated therewith. As indicated above, one condition which can cause the flow back of sea water into the cylinders of the engine after shutdown results because of the intermittently occurring pressure imbalance induced in the parallelly operating exhaust pipes or arms that are positioned downstream from the exhaust manifolds of the engine. The elegant solution of the present invention is to equalize this pressure imbalance between the exhaust pipe arms so that rising water, typically under hydrostatic pressure, does not rise a substantially greater distance in any one arm than the other(s). One of the reasons that the solution described herein is considered to be elegant is its simplicity in form and ease in implementation. By coupling a connective conduit between the arms, equalization is readily facilitated, provided the conduit is of sufficient size to accommodate the passage of fluid at a rate necessary to prevent sufficient rising in the lower-pressured pipe which would otherwise result in spill-over into the engine's cylinder(s).

In at least one embodiment, the invention takes the form of an arrangement for a marine combustion engine exhaust system. The arrangement includes at least two substantially upstanding exhaust pipe arms that are coupled together in common closed fluid communication with a stem exhaust pipe. A pressure equalizer is fluidly connected between the upstanding exhaust pipe arms. The pressure equalizer is configured to provide sufficient fluid passage from each exhaust pipe arm to another to prevent flow back of sea water to a marine combustion engine associated therewith.

BRIEF DESCRIPTION OF DRAWINGS

In the following, the invention will be described in greater detail by way of examples and with reference to the attached drawings, in which.

DETAILED DESCRIPTION

Figure 1:
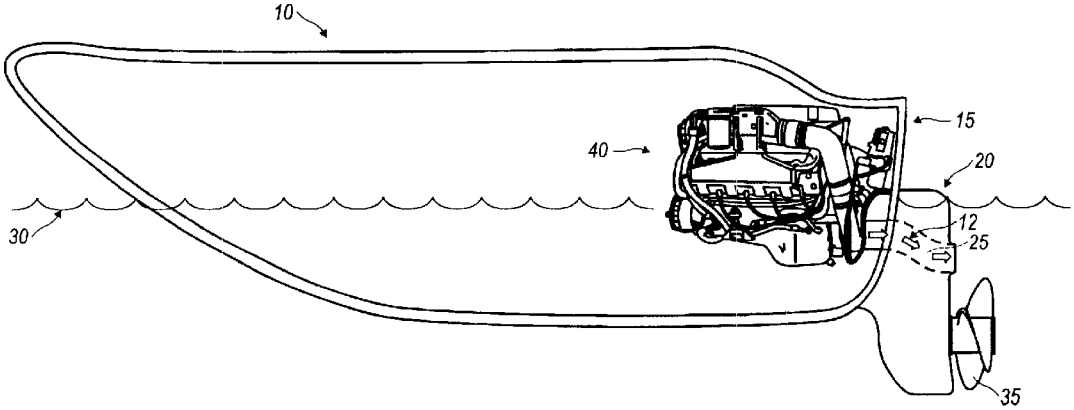
FIG. 1 is a schematic side elevational view of a water vehicle showing a combustion engine in a rear portion thereof connected to a stern drive unit.

Referring to the Figures were like reference numerals are used to identify like elements, a boat 10 is shown carrying a multi-cylinder 45 combustion engine 40 that is connected across a transom 15 of the boat 10 to a stern-drive unit 20, including a propeller 35. Referring specifically to FIG. 1, exhaust 12 from the engine 40 is shown to be ported across a transom plate forming part of the transom 15 and then through an exhaust passage 25 arranged within the stern-drive unit 20. A sea water line 30 is shown relative to the boat 10 and stern-drive unit 20 under standard displacement conditions typical for slow moving, and no movement conditions of the boat 10.

Figure 2:
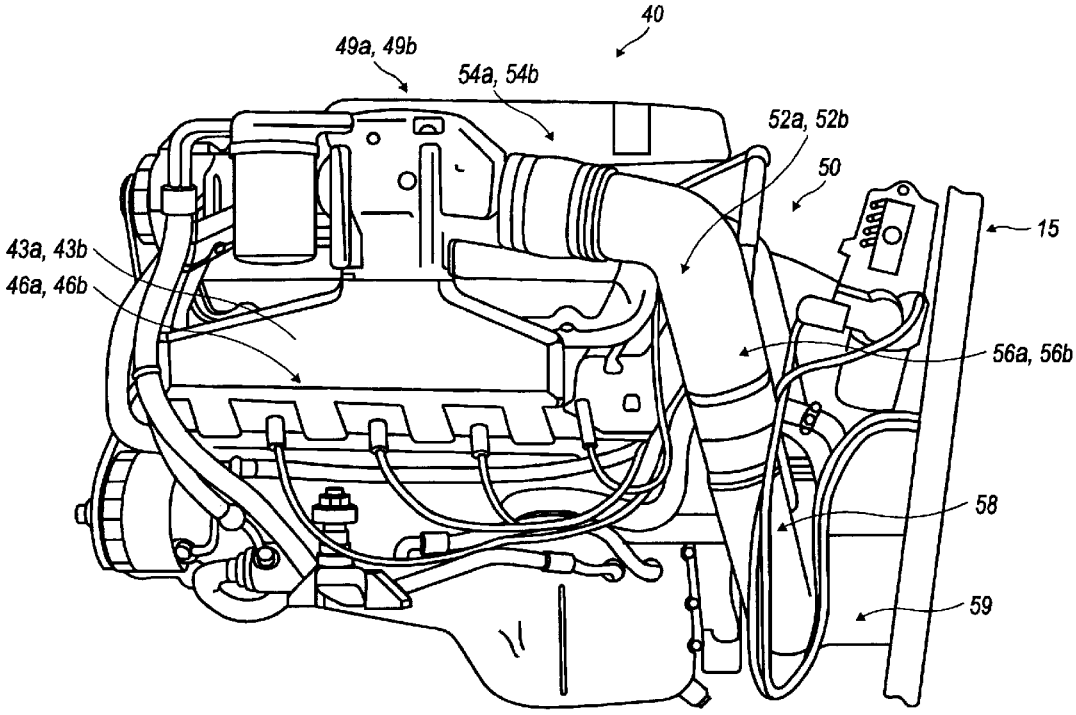
FIG. 2 is a side elevational view of the combustion engine.

FIG. 2 depicts a semi-detailed representation of the combustion engine 40. In this side view depiction, it should be appreciated that the design of the engine 40 is substantially symmetrical about a bisecting plane oriented vertically and substantially at a midpoint of the engine.

Henceforth, it should be understood that because of the substantially symmetrical construction of the illustrative combustion engine 40, many components exist in pairs, one on each side of the engine 40. These paired components are identified using like reference numerals, but with "a" and "b" suffixes. If both are referred to, or only on is visible, but it is desired to reference both, both suffixes are appended.

An exhaust path is established from two cylinder banks 46*a,b* that are respectively and fluidly connected to manifolds 43*a,b*, up through risers 49*a,b* where a substantially right angle turn is affected, with distribution of exhaust from the engine 40 to manifold exhaust pipes 54*a,b*. An exhaust system arrangement 50 is fluidly positioned downstream of the exhaust pipes 54*a,b* for continued conveyance of exhaust from the engine 40. In the illustrated embodiment, tightenable bands are positioned exteriorly at an entrance of the manifold exhaust pipes 54*a,b* for establishing a constrictive fit and seal about a terminal port from each respective riser 49*a,b*.

A downstream end of each exhaust pipe 54*a,b* is similarly connected to an upstream end of one of two exhaust pipe arms 56*a,b*. As may be appreciated from FIG. 2, each arm 56*a,b* includes a down-turning elbow 52*a,b*. As will be described in greater detail hereinbelow, lower ends of each of the two pipe arms 56*a,b* are fluidly connected together at a junction 57. Stem exhaust pipe 58 extends below the junction 57 and has a lower portion 59, that in the illustrated embodiment provides fluid connection to the exhaust passage 25 through the stern-drive unit 20 and from which the exhaust 12 is ultimately ported to the environment.

Figure 3:
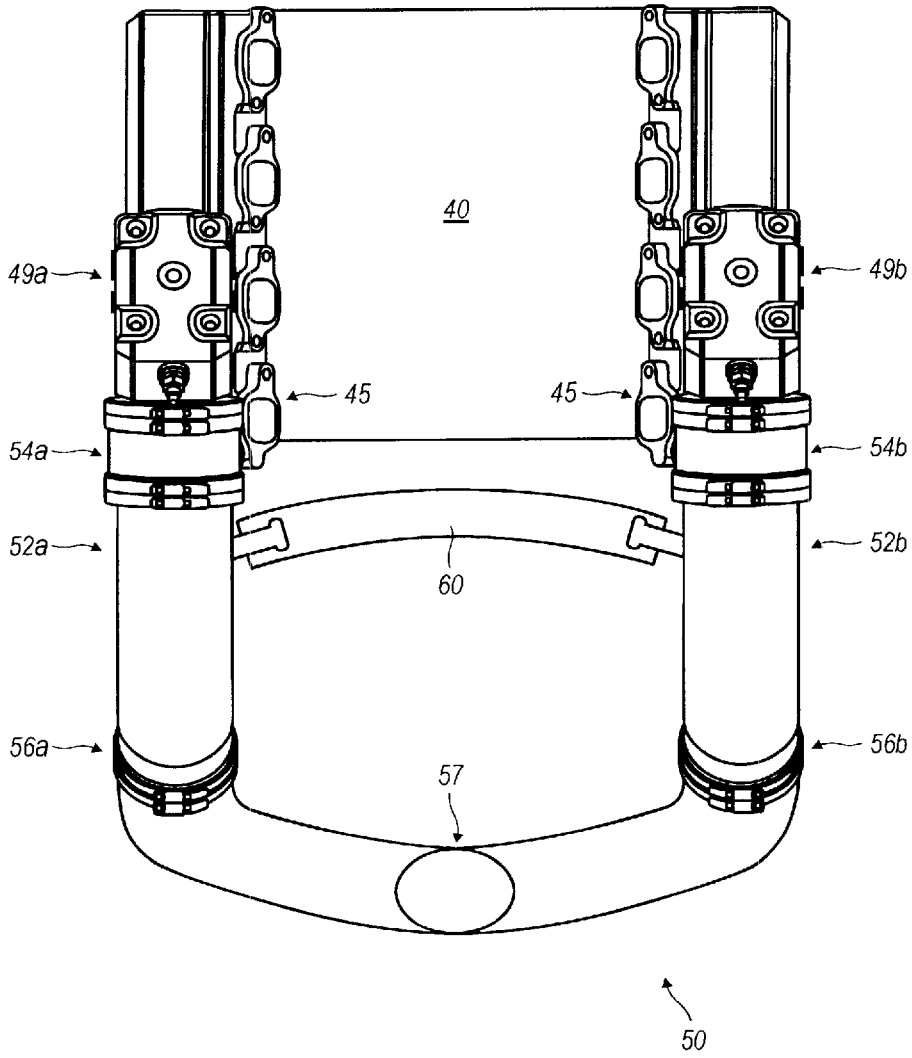
FIG. 3 is a top perspective view of the combustion engine and an associated exhaust system arrangement.

FIG. 3 shows a top perspective view, in partial cut away, of the engine 40 and exhaust system arrangement 50. From this view, the constrictive band connections between the risers 49, the manifold exhaust pipes 54 and the exhaust pipe arms 56 may be better appreciated. FIG. 3 also illustrates a pressure equalizer 60 fluidly connected between the exhaust pipe arms 56. In a preferred embodiment, the equalizer 60 is connected at each of two terminal ends thereof at the elbow 52*a,b* portions of the arms 56*a,b*. It is by this fluid connection that rapid equalization is accomplished between the exhaust pipe arms 56*a,b* during shutdown procedures under hydrostatic back pressure, regardless of the differential and exhaust pressure being distributed therebetween.

Figure 4:
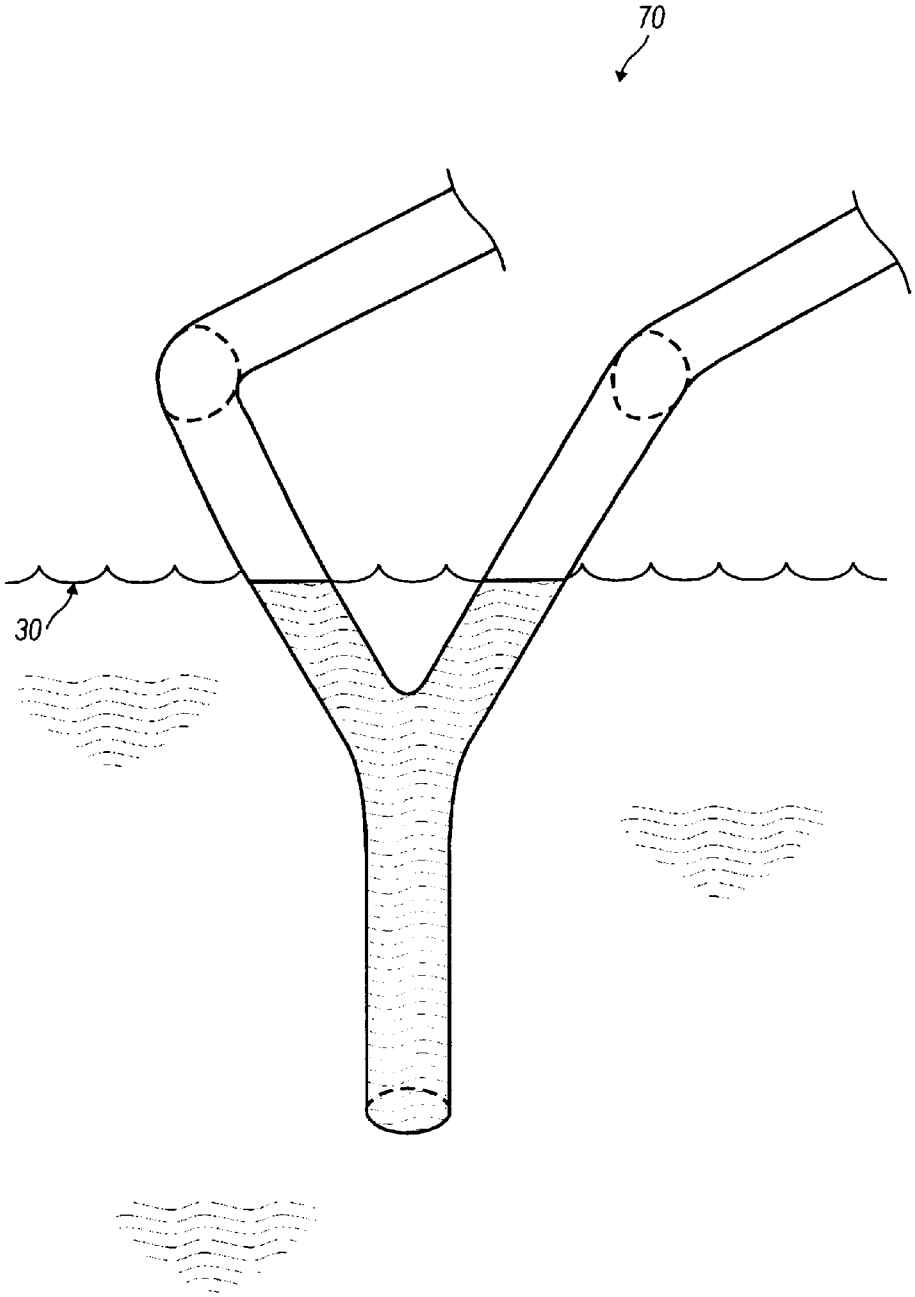
FIG. 4 is a schematic view of an unequalized arrangement under balanced pressure conditions.

FIG. 4 schematically represents a traditional exhaust configuration 70 under balanced pressure conditions. As indicated above, in a majority of shutdowns of the marine combustion engine 40, substantially balanced pressure will occur between the two exhaust pipe arms. The representation of FIG. 4 illustrates this situation after the boat has come to rest and an equalization responsive to the hydrostatic pressure experienced from the surrounding sea water 30 has occurred.

Figure 5:
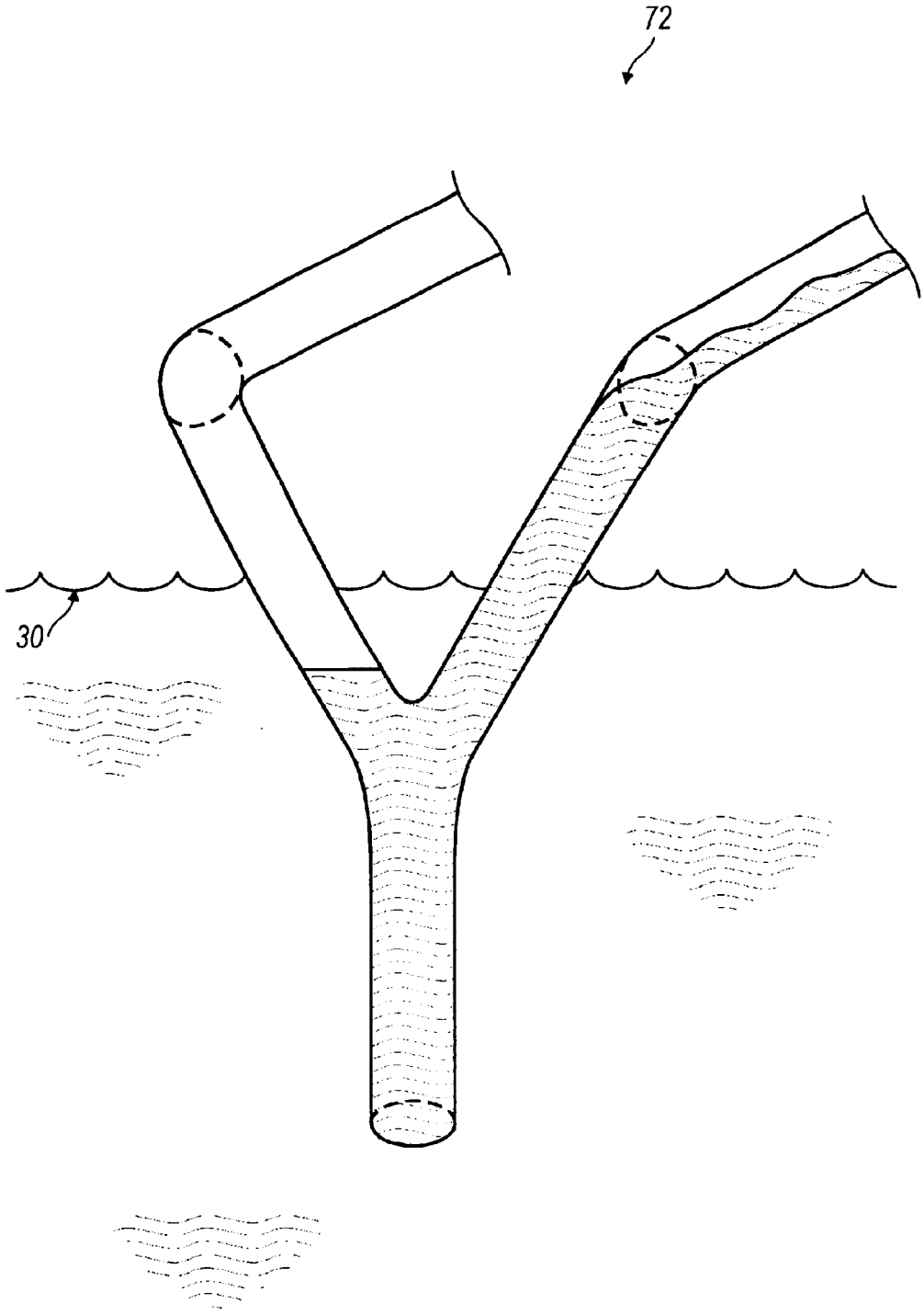
FIG. 5 is a schematic view of an unequalized arrangement under imbalanced pressure conditions showing sea water spilling and detrimentally draining toward the cylinder(s) of the combustion engine.

FIG. 5 illustrates the detrimental effect 72 described hereinabove in conventional exhaust systems during engine shutdown situations in which unlike exhaust pressures are distributed to the two different exhaust pipe arms. As the boat settles into the water 30 and hydrostatic pressure causes water to rise up through the lower trunk pipe and across the V-junction at the top thereof, the rising water is propelled up the lower pressure arm (in the illustrated case, the right arm) by the pressure differential induced by the two different exhaust pressures from the respective manifolds 43. The detrimental effect described hereinabove occurs, as is depicted in FIG. 5, when sea water spills over the top end of the arm, across the manifold exhaust pipe, and down into the engine's cylinder(s). Oftentimes this will result in hydrolocking of the engine with the detrimental consequences earlier described being experienced.

Figure 6:
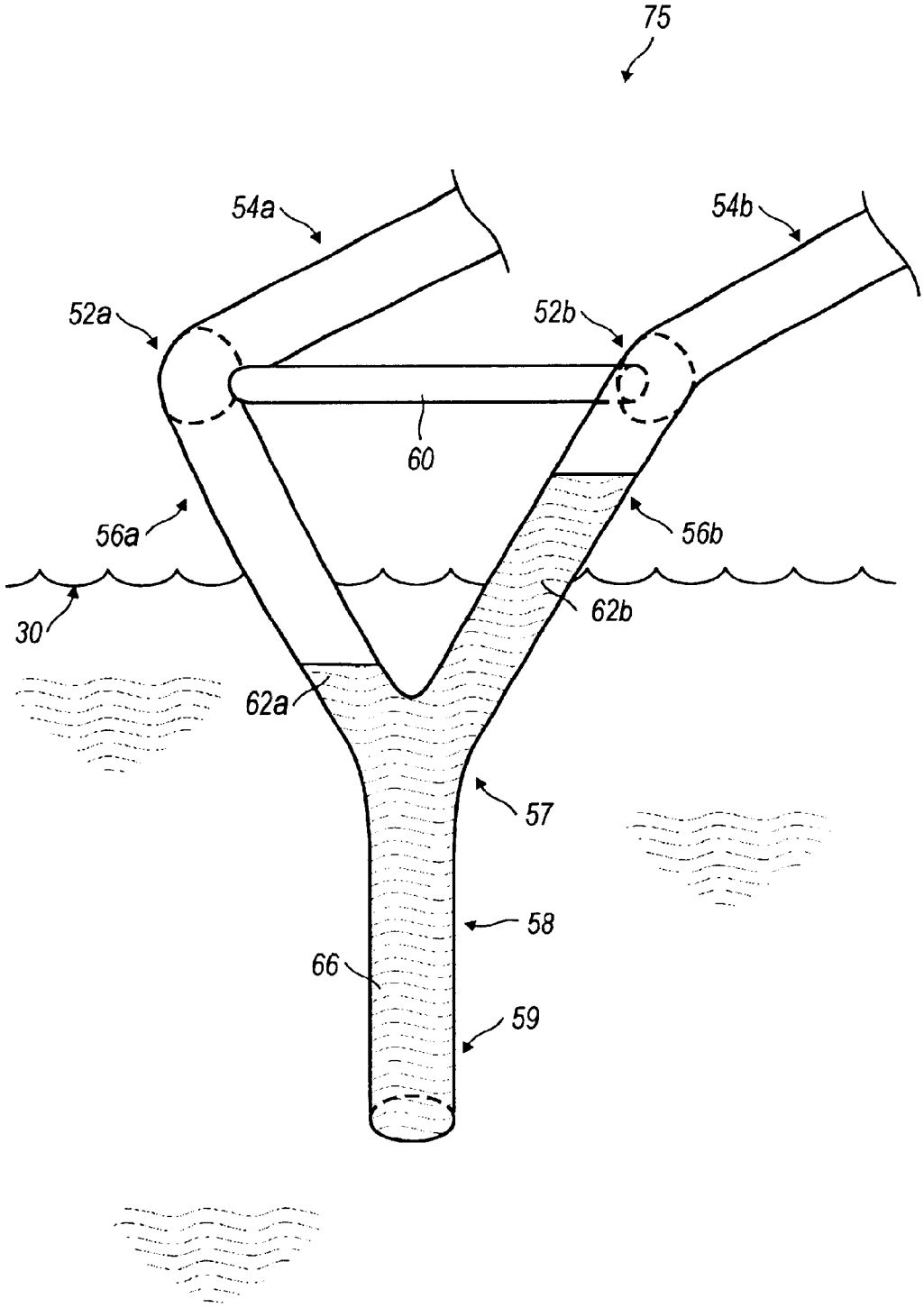
FIG. 6 is a schematic view of an equalized arrangement under imbalanced pressure conditions showing sea water being prevented from spilling and draining toward the cylinder(s) of the combustion engine.

FIG. 6 generally shows the Y-configuration established by the V-oriented pipe arms 56 containing respective upper water columns 66 atop the stem exhaust pipe 58 containing a lower water column 66. The Figure also illustrates the equalizing configuration 75 of the present invention in which the pressure equalizer 60 is fluidly connected, preferably at top ends of the V-oriented exhaust pipe arms 56, at locations adjacent to respective elbows 52 of the arms 56. In order to accommodate the requisite transfer of pressure between the two arms 56 during imbalanced exhaust pressure shutdown conditions, the conduit establishing the pressure equalizer 60 preferably has a cross-sectional area approximately one-third that of the arms 56 themselves. FIG. 6 shows a shutdown condition similar to that depicted in FIG. 5, but as may well be appreciated by the fact that neither of the upper water columns 62*a,b* is overflowing the top ends of the arms 56, detrimental effects to the engine 40 are avoided. The right upper water column 62*b* is higher than the left upper water columns 62*a*, but because of the provision of the pressure equalizer 60, the pressure at the top of higher pressured arm 56*a,b* is rapidly transferred over to the other arm 56*a,b* causing the relative pressures between the arms 56 to move toward a balanced condition. As a result, the two water columns 62 tend to rise up a distance more equal to one another thereby preventing overspill toward the engine 40.

Figure 7:
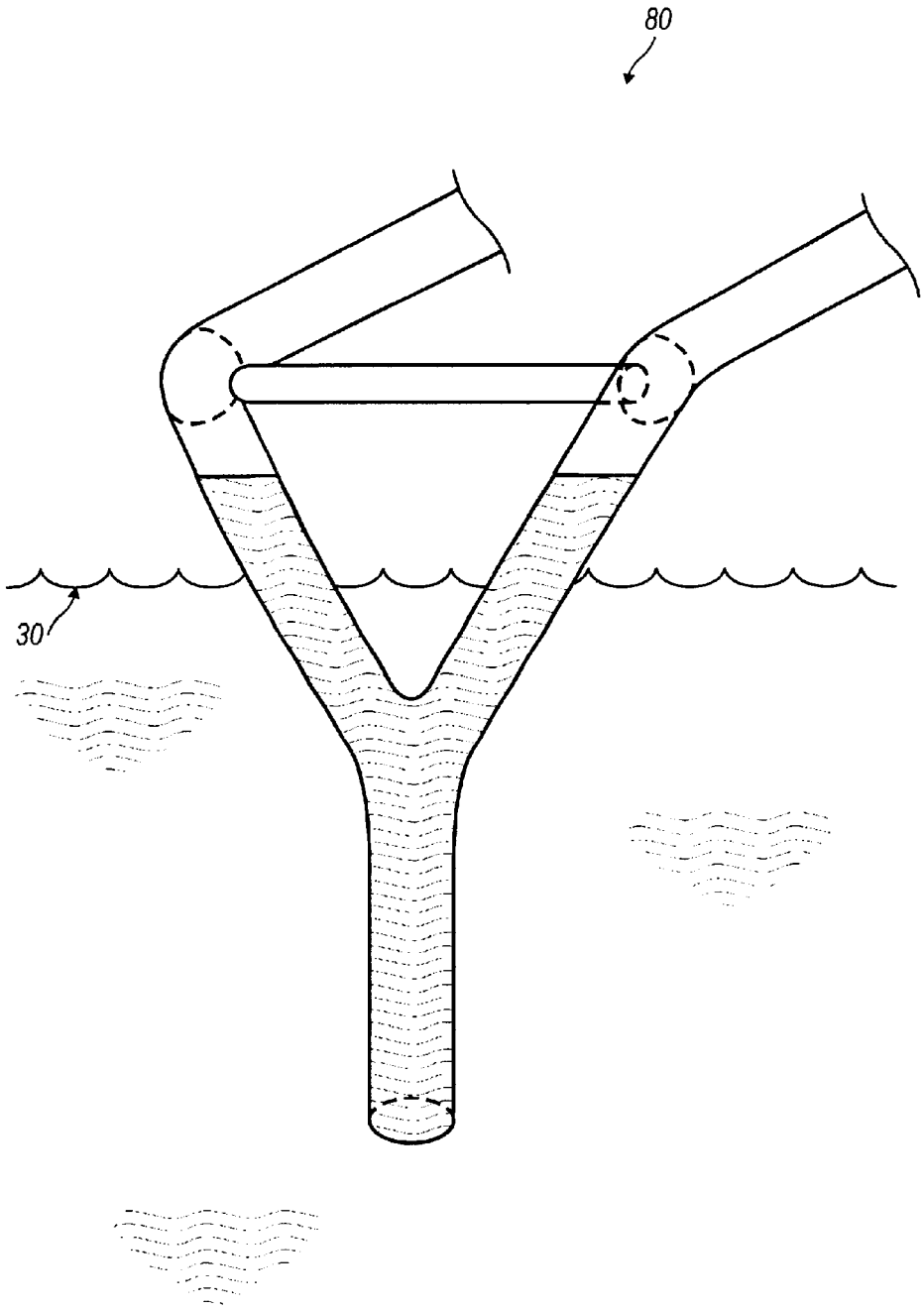
FIG. 7 is a schematic view of an equalized arrangement under transom surge, but balanced pressure conditions.

FIG. 7 illustrates an engine 40 shutdown occurring when the boat is traveling at a substantial rate of speed. This situation 80 can occur for multiple reasons, including the running out of fuel or purposeful killing of the engine's 40 operation. As described hereinabove, as the boat settles from planing operation to displacement operation, a surge pressure of sea water 30 against the transom is often experienced. This surge pressure can cause an increase in the rise of water in the exhaust system 50. By including the pressure equalizer 60, if imbalanced exhaust conditions do occur, it will be less likely that overflow situations into the engine 40 will occur thereby protecting the engine 40 against sea water 30 damage.

Figure 8:
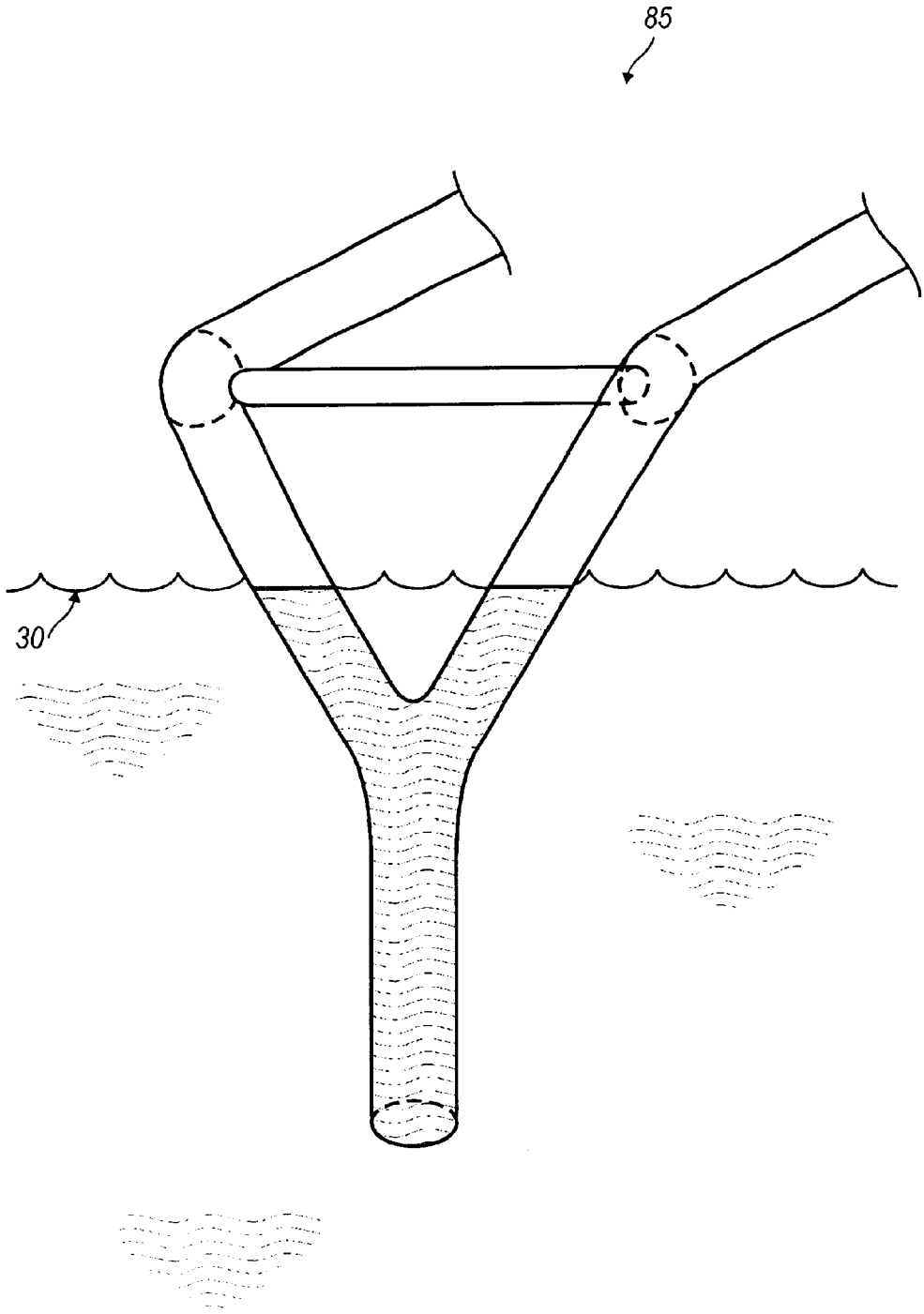
FIG. 8 is a schematic view of an equalized arrangement under balanced pressure conditions.

FIG. 8 illustrates the fact that the pressure equalizer 60 will permit the exhaust system arrangement 50 to experience balanced water rise responsive to hydrostatic pressure exerted by the sea water 30 when balanced exhaust pressure conditions 85 are experienced between the pipe arms 56.

It should be appreciated that illustrative embodiment(s) of the present inventive concept have been described in detail hereinabove. Those skilled in this art will recognize that equivalent arrangements may be utilized for similar protection of the engine and still fall within the scope of this patent. This style of protection, however, has heretofore been unavailable and not provided. As an example, it should be appreciated that the exhaust arrangement may be affected utilizing pipes as illustrated, or such alternatives as castings may be provided that establish a similar exhaust path. Such a configuration may even be integrally incorporated with portions of the engine's own structure. Similarly, it is irrelevant as to whether the exhaust arrangement is interior or exterior of the carrying vessel.

What is claimed is:

1. An arrangement in a marine combustion engine exhaust system, said arrangement comprising:

at least two substantially upstanding exhaust pipe arms, said upstanding exhaust pipe arms coupled together in common closed fluid communication with a stem exhaust pipe; and a pressure equalizer fluidly connected between said upstanding exhaust pipe arms, said pressure equalizer configured to provide sufficient fluid passage from each exhaust pipe arm to another to prevent flow back of sea water to a marine combustion engine associated therewith.

2. The arrangement in a marine combustion engine exhaust system as recited in claim 1, further comprising:

said upstanding exhaust pipe arms being positioned above said stem exhaust pipe and said upstanding exhaust pipe arms and said stem exhaust pipe being arranged in a substantially Y-shaped configuration.

3. The arrangement in a marine combustion engine exhaust system as recited in claim 1, wherein said pressure equalizer takes the form of a fluid communicating conduit.

4. The arrangement in a marine combustion engine exhaust system as recited in claim 1, wherein said upstanding exhaust pipe arms and said stem exhaust pipe are constructed from substantially three inch diameter conduit.

5. The arrangement in a marine combustion engine exhaust system as recited in claim 1, wherein said pressure equalizer is constructed from substantially one inch diameter conduit.

6. The arrangement in a marine combustion engine exhaust system as recited in claim 1, wherein a cross-sectional area of said pressure equalizer is approximately three times a cross-sectional area of said exhaust pipe arms and said stem exhaust pipe.

* * * * *